United States Patent [19]

Kruse et al.

[11] Patent Number: 4,803,929

[45] Date of Patent: Feb. 14, 1989

[54] PROJECTILE HAVING A ROTATING BAND DISPOSED ON THE PROJECTILE BODY

[75] Inventors: Heinz-Josef Kruse, Ratingen; Klaus D. Karius, Jüchen, both of Fed. Rep. of Germany

[73] Assignee: Rheinmetall GmbH, Düsseldorf, Fed. Rep. of Germany

[21] Appl. No.: 92,688

[22] Filed: Sep. 3, 1987

[30] Foreign Application Priority Data

Sep. 3, 1986 [DE] Fed. Rep. of Germany ..... 3630000

[51] Int. Cl.[4] ..... F42B 31/00

[52] U.S. Cl. ..... 102/524

[58] Field of Search ..... 102/501, 503, 511, 520–527

[56] References Cited

U.S. PATENT DOCUMENTS 160,569 3/1875 Butler .
293,337 2/1884 Mann .
2,663,068 12/1953 Towner .
2,759,421 8/1956 Sublette .
3,910,194 10/1975 Dehm et al. .

FOREIGN PATENT DOCUMENTS 709576 8/1941 Fed. Rep. of Germany .
731064 2/1943 Fed. Rep. of Germany .
309863 4/1929 United Kingdom .

*Primary Examiner*—Harold J. Tudor
*Attorney, Agent, or Firm*—Spencer & Frank

[57] ABSTRACT

A projectile for firing from a gun barrel which comprises a projectile body having a radial and longitudinal directions; a rotating band disposed on the projectile body and having at least one material receiving groove to accommodate rotating band material sheared off during passage of the projectile through the gun barrel, and at least one pressure relief groove located in a region of the rotating band where the projectile body is subjected to maximum stress in the radial direction.

8 Claims, 3 Drawing Sheets

PROJECTILE HAVING A ROTATING BAND DISPOSED ON THE PROJECTILE BODY

BACKGROUND OF THE INVENTION

1. Field of the Invention

The present invention relates to a projectile having a rotating band secured to the projectile body. The exterior surface of the rotating band engages the rifling of a gun barrel during firing thereby imparting spin to the projectile.

2. Discussion of the Prior Art

In spin stabilized projectiles, the spin is transferred to the projectiles by one or sometimes several rotating bands arranged one behind the other.

U.S. Pat. No. 3,910,194 shows that it is known to provide circumferential grooves in the rotating band to receive the rearwardly sheared off rotating band material. Customarily, the width of such grooves is no greater than 4 mm. The rotating bands may be composed of copper, soft iron or plastic.

In these known rotating bands, radial contact between gun barrel and rotating band takes place only by way of the band ribs between the grooves. This contact produces a radial pressure on the projectile 1 called the rotating band pressure.

Particularly if thin projectile bodies are employed in which the ratio of the wall thickness of the projectile body to the caliber of the gun barrel is customarily $\leqq 0.05$, the projectile reacts with particular sensitivity to radial pressures since certain points dependent on the geometry of the projectile may be subjected to great material stresses. As a result of these stresses the projectile body may be pressed inwardly so that the seal against the propelling gases usually provided by the rotating band is no longer ensured.

SUMMARY OF THE INVENTION

It is therefore an object of the present invention to provide a projectile in which the average rotating band pressure can be reduced and a better seal can be provided against the gas pressure particularly if very thin walled bodies are used.

The above and other objects are accomplished by the invention in which a projectile for firing from a gun barrel comprises a projectile body having radial and longitudinal directions; a rotating band disposed on the projectile body and having at least one groove to accommodate rotating band material sheared off during passage of the projectile through the gun barrel, and at least one pressure relief groove located in a region of the rotating band where the projectile body is subjected to maximum stress in the radial direction.

Thus the present invention is based on the idea that a relief groove is provided at those points in the rotating band where high radial stresses occur on the projectile body. No radial pressure as a result of contact is exerted on the projectile body in the axial, portion of this groove or grooves, if there are a plurality of grooves.

The axial extent of the relief grooves depends on the stiffness of the projectile body and should be greater than 4 mm for artillery ammunition employing metal rotating bands.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figure 1:
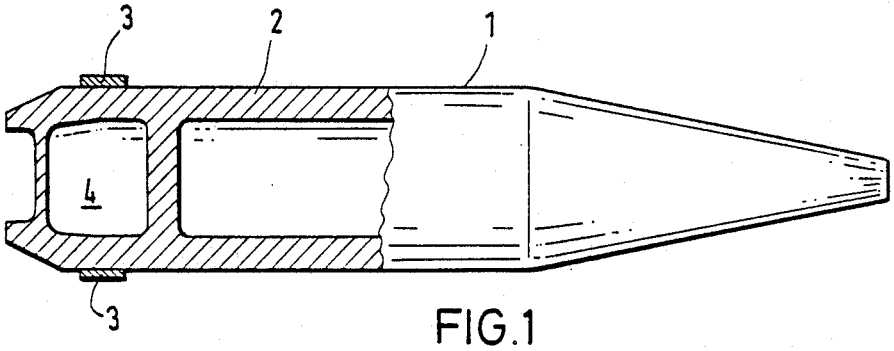
FIG.1 PRIOR ART
FIG. 1 shows a prior art projectile equipped with a rotating band according to the invention.

In FIG. 1, a projectile 1, projectile body 2 and the rotating band 3 are shown. Rotating band 3 has a diameter such that it is pressed fully into the barrel rifling during passage of the projectile through the gun barrel. By way of the lands of the rifling, the rotating band transfers a spin to the projectile and simultaneously forms a seal against the powder gases. In the region of rotating band 3, projectile 1 has a cavity 4 in its interior in which, for example, a braking parachute (not shown) may be accommodated.

Figure 2:
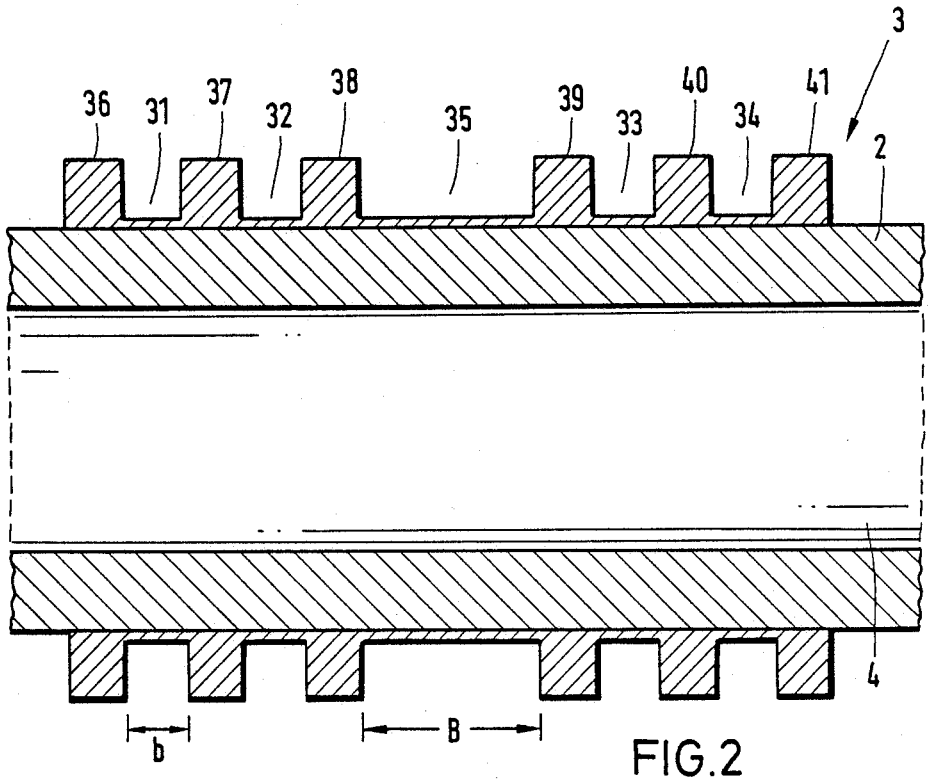
FIG. 2 is a detailed longitudinal cross-sectional view of a rotating band according to the invention disposed on the projectile body.

In FIG. 2, which shows part of projectile body 2, rotating band 3 has grooves 31 to 34 which serve, in a known manner, to accommodate the material of the rotating band sheared off during passage of the projectile through the gun barrel.

Radial contact between gun barrel and rotating band 3 exists only at rotating band rings 36 to 41.

Figure 3:
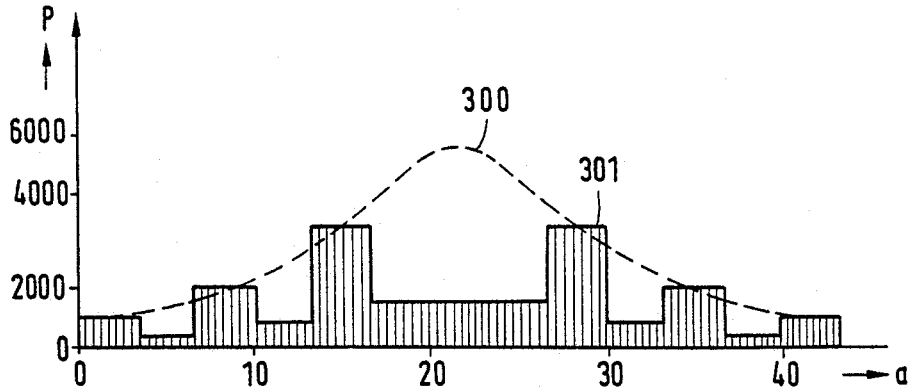
FIG. 3 shows the distribution of pressure along the rotating band of FIGS. 1 and 2.

FIG. 3 shows the example of radial pressure distribution along the rotating band. The distance a (in mm) from the leading edge of the rotating band is plotted on the abscissa and the rotating band pressure P (in bar) is plotted on the ordinate. The dashed curve 300 shows the rotating band pressure distribution for a rotating band without grooves according to the projectile and band configuration shown in FIG. 1. It can be clearly seen that a maximum rotating band pressure occurs approximately in the center of the rotating band.

Consequently, it has been determined that a relief groove must be provided in this region. This groove is marked 35 in FIG. 2 and its width B should be more than 4 mm.

For artillery projectiles the width B should lie between 6 and 20 mm depending on the type of projectile. However, it must be considered that the total width of the rotating band rings on such projectiles should be about 20 mm (typically, rotating bands have a width from 38 to 40 mm).

The stepped curve 301 in FIG. 3 represents the approximate pressure distribution of rotating band 3 of FIG. 2. Relief groove 35 causes the rotating band pressure in this region to noticeably decrease.

Depending on the determined rotating band pressure distribution, it is also possible to provide a plurality of relief grooves.

Figure 4:
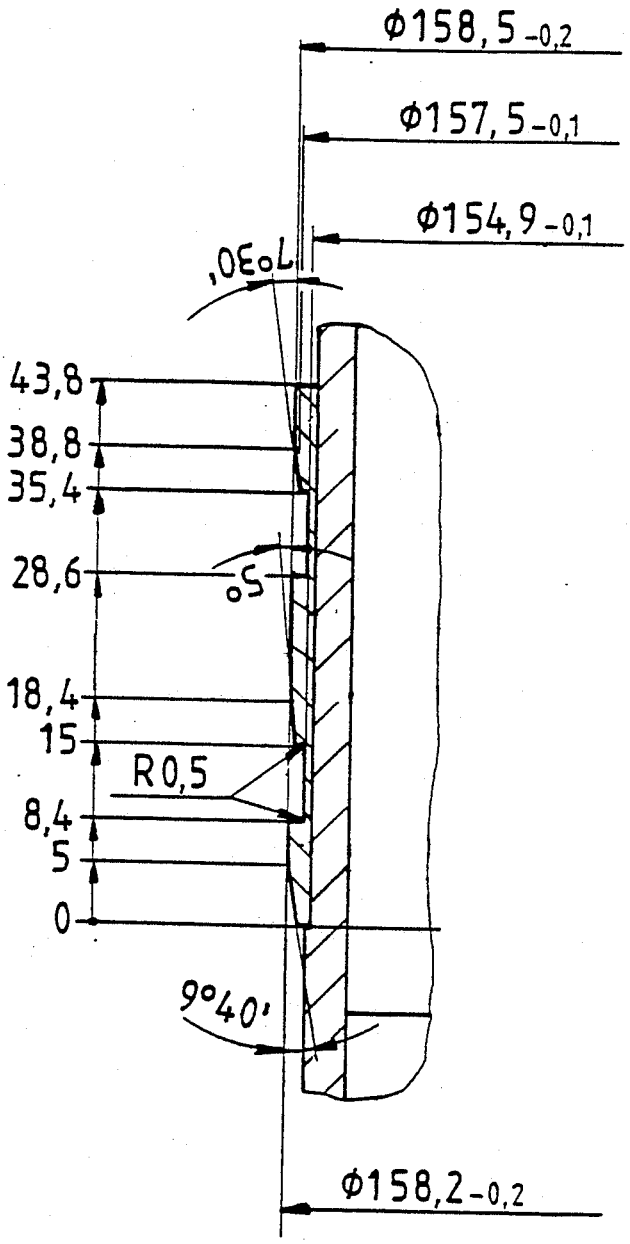
FIG. 4 shows a rotating band as it has recently been designed for a 155 mm thin walled carrier shell.

FIG. 4 shows the actual geometry of a rotating band which has recently been designed for a 155 mm thin walled carrier shell. There are two relief grooves of 6.6 mm and 6.8 mm, respectively, in length.

It will be understood that the above description of the present invention is susceptible to various modifications, changes and adaptations, and the same are intended to be comprehended within the meaning and range of equivalents of the appended claims.

What is claimed is:

1. A projectile for firing from a gun barrel comprising: a projectile body having radial and longitudinal directions; a rotating band disposed on said projectile body and having a width in said longitudinal direction and including at least three band rings; one of said band rings being located at each end of said width of said rotating band; at least one material receiving grooves in said rotating band to accommodate rotating band material sheared off during passage of said projectile through the gun barrel; and at least one pressure relief groove located in a region of said rotating band where said projectile body is subjected to maximum stress in said radial direction, and wherein said pressure relief groove and said material receiving groove each have a width in said longitudinal direction; the width of said pressure relief groove being greater than the width of said material receiving groove.

2. A projectile for firing from a gun barrel according to claim 1, wherein said width of said pressure relief groove is greater than 4 mm.

3. A projectile for firing from a gun barrel according to claim 2, wherein said width of said pressure relief groove is in the range of 6 to 20 mm.

4. A projectile for firing from a gun barrel according to claim 1, said rotating band further comprising at least four band rings and having at least two material receiving grooves, wherein said pressure relief groove is located between said two material receiving grooves and is separated from each of said material receiving grooves by a respective band ring.

5. A projectile for firing from a gun barrel wherein said projectile has a wall thickness whose ratio to the caliber of the gun barrel is at the most 0.05, said projectile comprising: a projectile body and having radial and longitudinal directions; a rotating band disposed on said projectile body having a width in said longitudinal direction and including a plurality of band rings; one of said band rings being located at each of said width of said rotating band; at least one material receiving groove in said rotating band to accommodate rotating band material sheared off during passage of said projectile through the gun barrel; and at least one pressure relief groove located in a region of said rotating band where said projectile body is subjected to maximum stress in said radial direction, and wherein said pressure relief groove and said material receiving groove each have a width in said longitudinal direction; the width of said pressure relief groove being greater than the width of said material receiving groove.

6. A projectile for firing from a gun barrel according to claim 5, wherein said width of said pressure relief groove is greater than 4 mm.

7. A projectile for firing from a gun barrel according to claim 6, wherein said width of said pressure relief groove is in the range of 6 to 20 mm.

8. A projectile for firing from a gun barrel according to claim 5, said rotating band further comprising at least four band rings and having at least two material receiving grooves, wherein said pressure relief groove is located between said two material receiving grooves and is separated from each of said material receiving grooves by a respective band ring.

* * * * *

UNITED STATES PATENT AND TRADEMARK OFFICE

CERTIFICATE OF CORRECTION

PATENT NO. : 4,803,929

DATED : February 14, 1989

INVENTOR(S) : Heinz-Josef Kruse et al

It is certified that error appears in the above-identified patent and that said Letters Patent is hereby corrected as shown below:

Column 4, line 2, delete "and" (first occurrence).
Column 4, line 6, after "each" insert --end--.

Signed and Sealed this

Seventh Day of January, 1992

*Attest:*

HARRY F. MANBECK, JR.

*Attesting Officer*

*Commissioner of Patents and Trademarks*